US005730521A

United States Patent [19]

Spink et al.

[11] Patent Number: 5,730,521

[45] Date of Patent: Mar. 24, 1998

[54] GLARE CONTROL SPORTS LIGHTING LUMINAIRE

[75] Inventors: Kenneth M. Spink, Jerome, Mich.; Thomas M. Lemons, Marblehead, Mass.

[73] Assignee: International Sports Lighting, Inc., Hillsdale, Mich.

[21] Appl. No.: 645,290

[22] Filed: May 13, 1996

[51] Int. Cl.[6] ..... F21S 3/00

[52] U.S. Cl. ..... 362/217; 362/297; 362/349; 362/350

[58] Field of Search ..... 362/217, 297, 362/307–311, 347, 348, 350, 268

[56] References Cited

U.S. PATENT DOCUMENTS

| | | | |
|---|---|---|---|
| 1,166,685 | 1/1916 | Holland et al. . | |
| 1,326,014 | 12/1919 | Bailey | 362/268 |
| 1,357,034 | 10/1920 | D'Humy . | |
| 1,406,648 | 2/1922 | Ingols . | |
| 1,455,929 | 5/1923 | Neff | 362/268 |
| 1,538,014 | 5/1925 | Whitaker . | |
| 1,559,185 | 10/1925 | Sams | 362/347 |
| 1,600,682 | 9/1926 | McCarley | 362/348 |
| 2,253,409 | 8/1941 | Winkler et al. | 362/268 |
| 3,265,883 | 8/1966 | Tolbert | 240/25 |
| 3,354,343 | 11/1967 | Myers | 362/217 |
| 4,420,800 | 12/1983 | Van Horn | 362/297 |
| 4,420,801 | 12/1983 | Reiling et al. | 362/297 |
| 4,447,865 | 5/1984 | Van Horn et al. | 362/305 |
| 4,556,928 | 12/1985 | Tysoe | 362/309 |
| 4,604,680 | 8/1986 | Levin et al. | 362/293 |
| 4,677,532 | 6/1987 | Peitz et al. | 362/61 |
| 4,725,934 | 2/1988 | Gordin | 362/298 |
| 4,816,974 | 3/1989 | Gordin | 362/261 |
| 4,855,885 | 8/1989 | MacEachern et al. | 362/298 |
| 5,075,828 | 12/1991 | Gordin et al. | 362/297 |
| 5,119,276 | 6/1992 | Sozuki | 362/61 |
| 5,161,883 | 11/1992 | Gordin et al. | 362/263 |
| 5,211,473 | 5/1993 | Gordin et al. | 362/297 |
| 5,313,379 | 5/1994 | Lemons et al. | 362/298 |
| 5,400,223 | 3/1995 | Speaker et al. | 362/21 |

*Primary Examiner*—Carroll B. Dority
*Attorney, Agent, or Firm*—Young & Basile, P.C.

[57] ABSTRACT

A luminaire especially suited for sports and roadway applications. The reflector of the luminaire has a modified parabolic shape wherein a true parabolic curve has been tipped inwardly to produce a tipped parabolic reflector having a circle of focal points centered on the focal point of the original true parabolic curve. The lamp comprises a double-ended arc lamp which is positioned transversely of the central axis of the reflector with the arc of the lamp generally tangent to top dead center of the focal point circle. The luminaire further includes a vertical black partition positioned within the reflector below and forwardly of the lamp and a specular insert in the upper front region of the reflector. The front edge of the specular insert is generally contiguous with the rear edge of a flat upper portion of a visor positioned against the front face of the reflector with the specular insert angled upwardly with respect to the central axis of the reflector and the flat visor portion angled downwardly with respect to the central axis. In an alternate embodiment a stepped lens is provided between the lamp and the front face of the reflector so as to block a direct frontal view of the arc. In a further alternate embodiment a true parabolic reflector bowl in positioned in the back half of the tipped parabolic reflector to provide a narrow concentrated beam. In a further alternate embodiment, the clear lens that covers the front reflector face is replaced by a lateral spread lens to increase the beam width and reduce direct lamp glare.

39 Claims, 5 Drawing Sheets

FIG-1
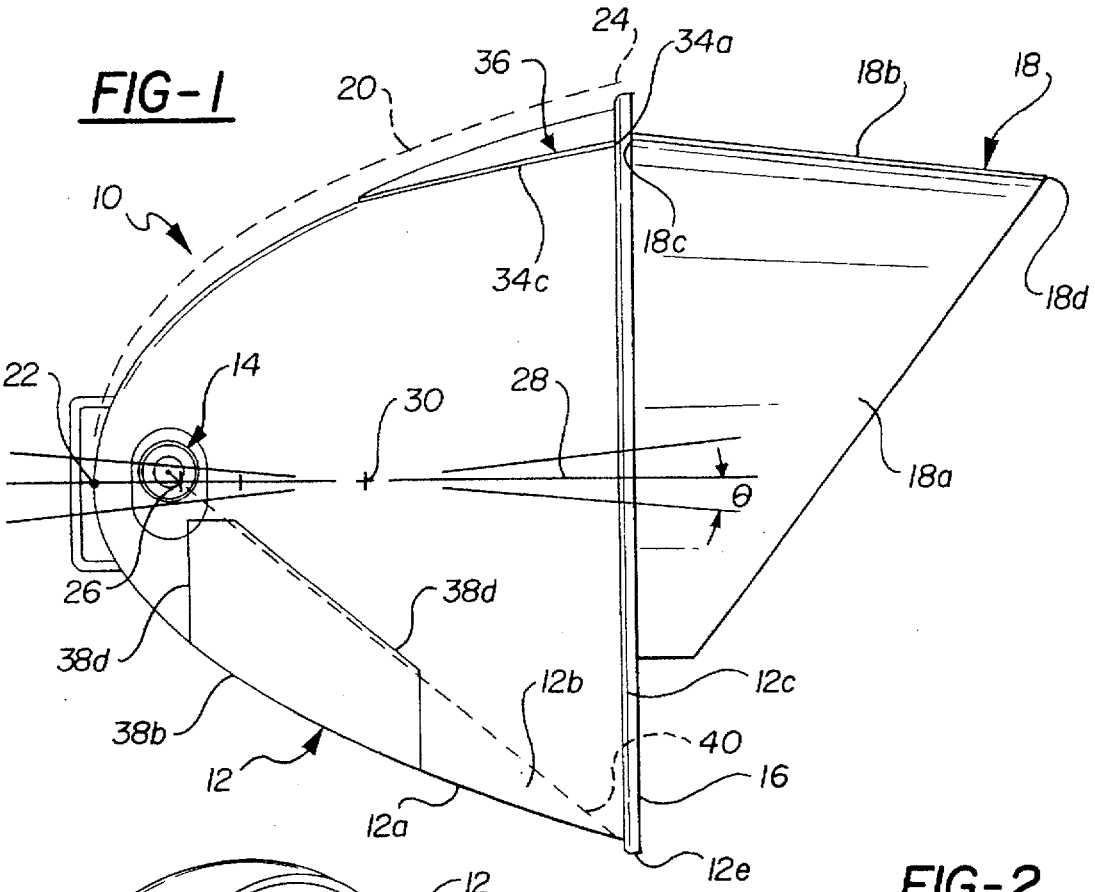
FIG-2
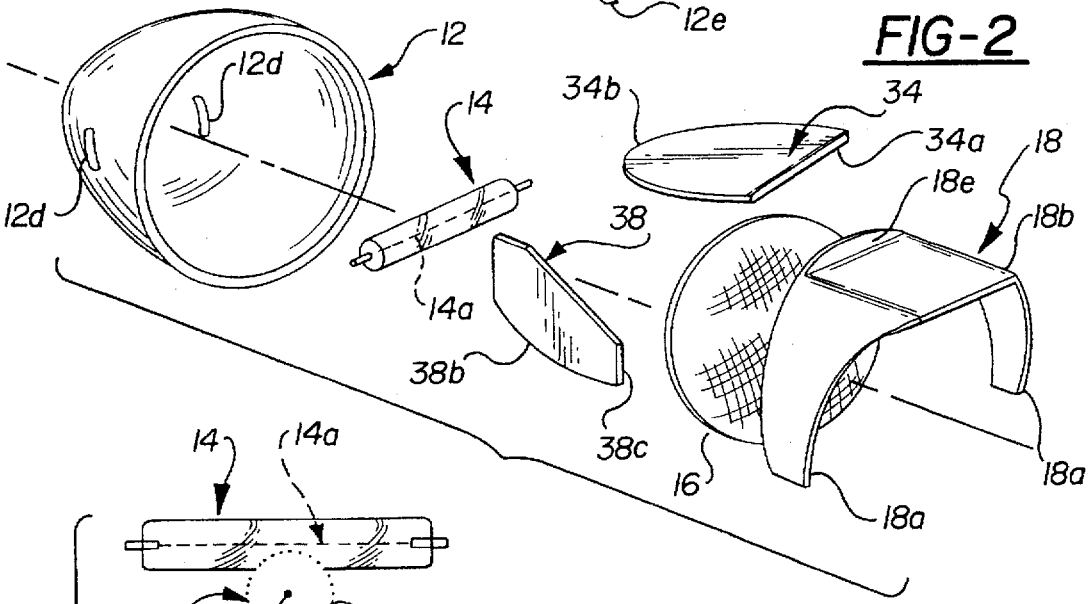
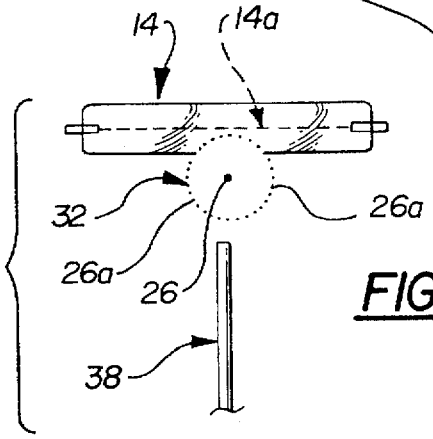
FIG-3

FIG-7
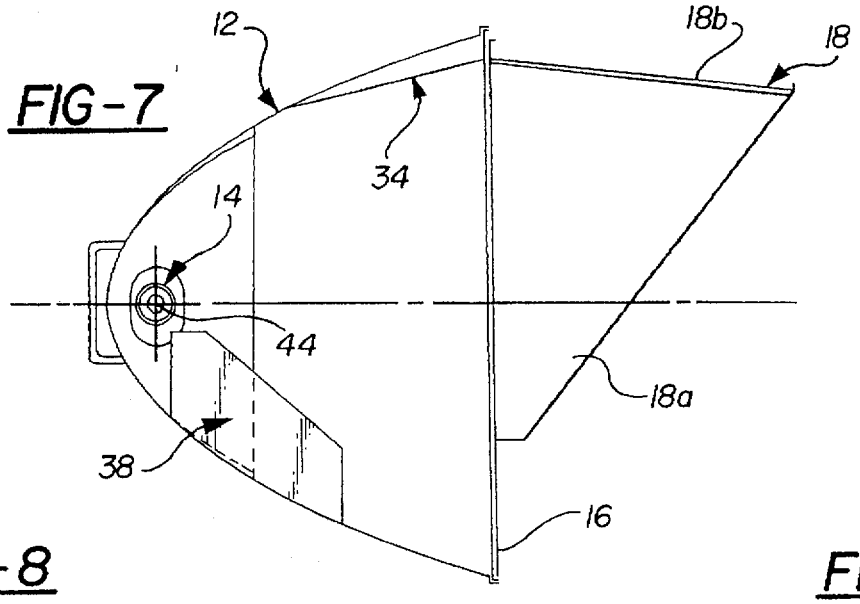
FIG-8
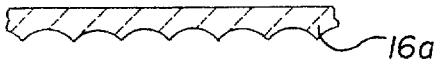
FIG-10
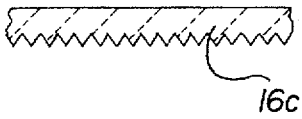
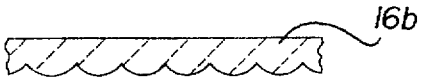
FIG-9
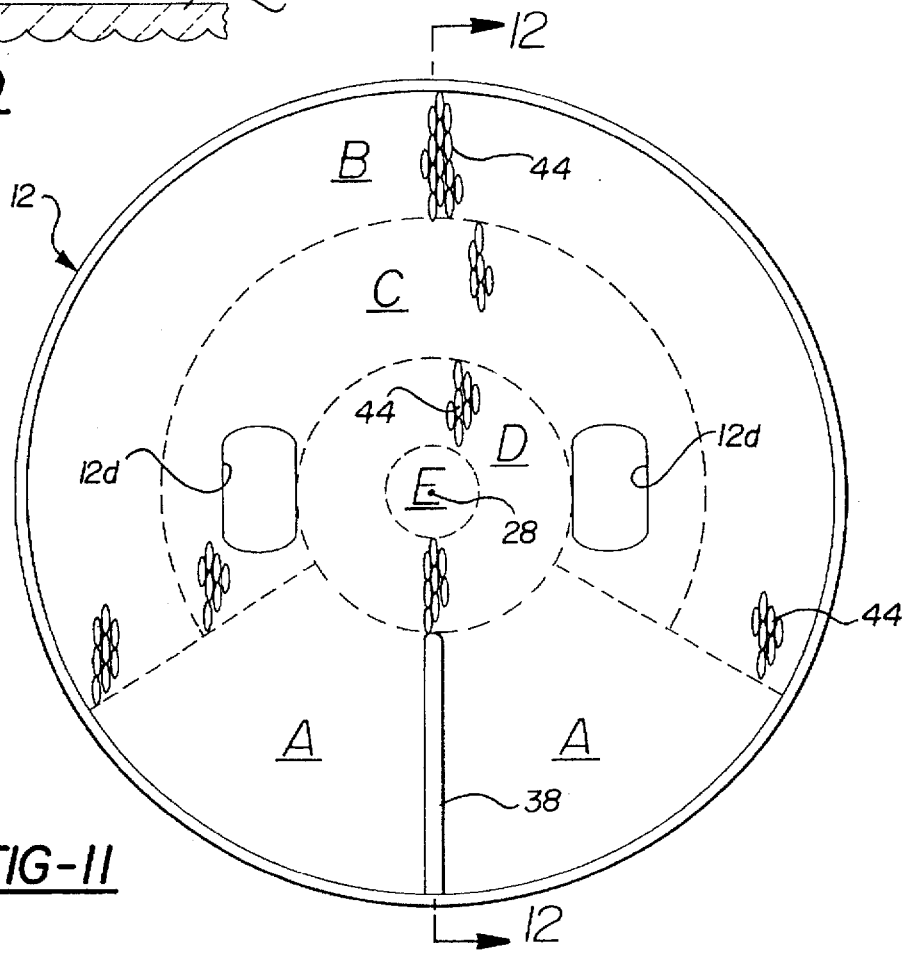
FIG-11

GLARE CONTROL SPORTS LIGHTING LUMINAIRE

BACKGROUND OF THE INVENTION

This invention relates to lighting luminaires for sports lighting or roadway lighting and more particularly to lighting luminaires with specific provision for controlling and minimizing glare and spillage.

Illumination of sports areas such as football fields, baseball diamonds, soccer fields, and the like, wherein a plurality of powerful luminaires are used to illuminate a particular area, is becoming a complex science.

When illuminating athletic fields the area may require a uniform illumination intensity or density throughout the area or when illuminating a baseball diamond it may be desirable that different intensities and illumination be present at predetermined areas. For instance, the infield may be lighted brighter than the outfield. Powerful luminaires utilizing arc-type light sources in conjunction with parabolic reflectors are commonly used for such outdoor lighting, and while such luminaires are capable of producing the desired degree of illumination, considerable problems and controversy have resulted due to the inadvertent illumination of adjacent areas. For instance, athletic fields are often located in or near residential areas and the homeowners object to the high intensities of light being spilled upon their property.

The control of light spillage has been largely accomplished in the past by the use of glare shields built into the light source or the luminaire which are intended to limit the light being cast to those areas intended. It has also been known to use visors to control light spillage beyond the remote areas being illuminated, and lens configurations have also been employed. Whereas these prior art devices achieve some degree of success in controlling glare and spillage, they also have the effect of reducing the amount of light delivered to the desired area and thus reduce beam utilization.

SUMMARY OF THE INVENTION

This invention is directed to the provision of an improved sports lighting luminaire.

More particularly, this invention is directed to the provision of a sports lighting luminaire having a more efficient asymmetric beam pattern with improved upper beam cutoff, The invention luminaire is of the type including a reflector and a lamp positioned generally within the reflector.

According to one aspect of the invention, the lamp comprises an elongated lamp positioned within the reflector and extending transversely of the aiming axis of the reflector, and the reflector is formed as a tipped or modified parabola. Specifically, the reflector is formed by establishing a parabolic curve having a back end, a front end, and a focal point with the central aiming axis of the reflector passing through the back end of the curve and the focal point of the curve, tilting this curve at an angle to the aiming axis, and rotating this curve about the central aiming axis to produce the surface of revolution of the reflector. The double-ended lamp generates a beam that is generally wide horizontally and generally narrow vertically and the modified parabolic reflector has the effect of expanding and modifying the high intensity central spot of the beam and the further effect of spreading the beam vertically.

According to a further feature of the invention, the lamp is positioned above the luminaire axis proximate the focal point of the parabolic curve. This specific lamp positioning has the effect of tilting the light downwardly to minimize spill light and increase the desired downward lighting.

According to a further feature of the invention, the luminaire further includes a generally vertical partition positioned in the reflector below the lamp and generally centrally of the lamp. This partition provides effective upper spill light control with respect to light directed upwardly from the lower front area of the reflector on either side of the lower vertical axis of the reflector.

According to a further feature of the invention, the luminaire further includes a flat specular insert positioned within the reflector above the lamp in the forward upper portion of the reflector, and a visor positioned on the front face of the reflector and defining a flat upper portion extending forwardly from a location proximate the front face of the reflector and proximate the front edge of the specular insert. The specular insert and flat upper portion coact to provide effective upward spill light control without creating any loss of luminaire efficiency caused by the trapping of light in the upper spill control structure.

According to a further feature of the invention, the luminaire further includes a lens positioned on the central axis of the reflector between the lamp and the front face of the reflector. This lens, which preferably has a diameter greater than the major dimension of the lamp, focuses light from the lamp into the general beam of the luminaire and eliminates a view of the lamp through the face of the luminaire.

According to a further feature of the invention, the clear front window or lens normally utilized to enclose and make the luminaire weatherproof is replaced by a spread lens. The spread lens is fluted with concave or convex linear flutes or a sawtooth linear pattern. The choice of the radius of curvature and width of the flutes, or the angle and width of the faces of the sawtooth, selectively spreads the light beam. Replacing the clear lens with a spread lens oriented vertically will spread the light beam produced by the luminaire laterally without altering the beam's upward cut off. The choice of the flute and sawtooth patterns will allow the lateral beam to be widened from as little as 6° to over 45°, thereby expanding the options for meeting the needs of large facilities such as a stadium to a small area such as a single tennis court. The flute or sawtooth patterns also function to block a direct view of the lamp to control direct glare.

According to a further feature of the invention, the reflective face of the luminaire is provided with a pattern of vertical peening. The pattern of vertical peening has the effect of selectively widening the beam produced by the luminaire.

According to a further feature of the invention, the luminaire further includes a true parabolic reflector bowl positioned in the center back half of the modified parabolic reflector. This arrangement has the effect of focusing a lamp placed at the focal point of the true parabolic insert into a brighter, narrower vertical beam and is therefore useful in applications where a more intense center beam is desired.

According to a further feature of the invention, a larger specular insert is positioned within the reflector above the lamp to expand the lower vertical beam. This insert does not modify the upward spill control or reduce the luminaire efficiency but only extends light from where the luminaire is aimed back toward the luminaire mounting location. The use of this increased lower vertical beam spread is required where luminaire mounting locations are near the edge of playing fields in small, often recreational, facilities.

BRIEF DESCRIPTION OF THE DRAWINGS

FIG. 1 is a cross-sectional view of a luminaire according the invention;

FIG. 2 is an exploded perspective view of the luminaire of FIG. 1;

FIGS. 3 and 4 are detailed views of the luminaire of FIG. 1 showing various optical relationships;

FIG. 7 is a cross-sectional view of a still further embodiment of the invention luminaire;

FIGS. 8, 9, and 10 are detailed views showing alternate forms of a spread lens for use with the invention luminaire;

FIGS. 11 and 12 are front and cross-sectional views, respectively, showing a peening pattern for use on the reflector of the invention luminaire;

DETAILED DESCRIPTION OF THE PREFERRED EMBODIMENTS

Figure 4:
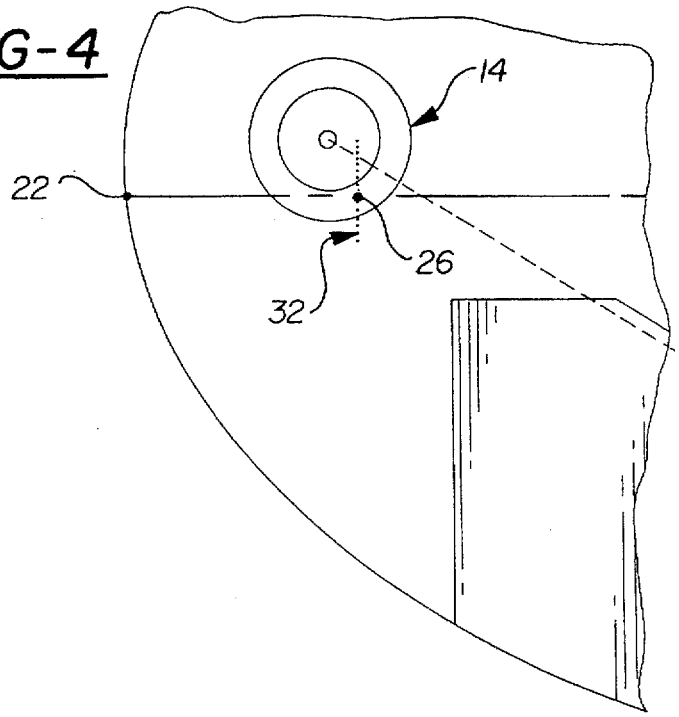
Figure 6:
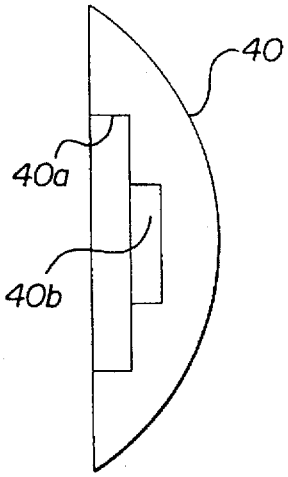
FIG. 6 is a sectional view of a lens employed in the luminaire of FIG. 5.

The luminaire 10 seen in FIG. 1 is intended primarily for use in a sports lighting environment and, broadly considered, includes a reflector 12, a lamp 14, a window lens 16, and a visor 18.

Reflector 12 may be formed of aluminum or the like and includes, in known manner, an outer slightly concave surface 12*a* and an inner increasingly concave reflecting surface 2*b*. Reflector 12 is formed by establishing a parabolic curve 20 having a back end 22, a front end 24, a focal point 26 and a central aiming axis 28 passing through the back end 22 and the focal point 26; tilting curve 20 forwardly and downwardly about a pivot point 30 to an angle θ of between 4° and 8° with respect to the central aiming axis; and rotating the tilted curve about the central aiming axis 28 to produce the surface of revolution of the reflector 12. Reflector 12 may, for example, have a diameter at the front circular face 12*c* of approximately 24 inches and a depth measured from front face 12*c* to back end 22 of approximately 19 inches; the original parabolic curve 20 may have a focal length of 2½ inches so that the focal point 26 of the original parabolic curve is positioned approximately 2½ inches forwardly of back end 22; the pivot point 30 may be located 8.927 inches forwardly of back end 22; and curve 20 may be tilted through an angle θ of 5.75°.

The effect of tilting the curve 20 about the pivot point 30 is to replace the single focal point 26 of original parabolic curve 20 with a circle 32 of focal points 26*a* positioned in concentric relation to original focal point 26 and axis 28 and at the same 2½ inch focal length as the original focal point 26. With the given reflector dimensions, circle 32 will have a radius of ⅝ of an inch. Circle 32 will be understood to be made up of a plurality of focal points 26*a* with each sector of the modified parabolic reflector contributing a first focal point 26*a* on one side of the axis 28 and a second focal point 26*a* diametrically opposed to the first point so that all of the sectors, taken cumulatively, generate the described circular configuration.

Lamp 14 comprises a double-ended high intensity discharge (HID) lamp of an elongated configuration and is positioned within the rear end of the reflector 12 in a transversely extending disposition with respect to axis 28 and with the arc 14*a* of the lamp positioned proximate focal point 26. Specifically, the lamp is positioned to dispose arc 14*a* at a location ¼ inch behind focal point 26 and ⅝ of an inch above focal point 26. This positioning of lamp 14 positions the arc 14*a* of the lamp tangential with respect to the top dead center of circle 32, as best seen in FIG. 3, but ¼ inch behind the circle. Lamp 14 may be suitably positioned within reflector 12 utilizing openings 12*d* on either side of the reflector for the passage of suitable mounting and current carrying hardware for mounting and energization of the lamp. Lamp 14 may comprise, for example, a 2000 watt HID lamp available from Osram Sylvania of Danvers, Mass. as Item No. 66631. This particular lamp has an external length of 10 inches, a nominal arc length of 4 ¼ inches, and an arc thickness of ⅜ inch. It will be understood that suitable ballasts and igniters will be provided to ensure efficient operation of the lamp.

Window lens 16 may be formed of flat clear glass, for example, and has a circular configuration sized to enclose the open circular front face 12*c* of the reflector. Lens 16 is secured, for example, with a rim structure 12*e* at the front face of the reflector. Alternatively, lens 16 may comprise a spread lens 16*a* with vertically oriented concave flutes (FIG. 8); a spread lens 16*b* with vertically oriented convex flutes (FIG. 9); or a spread lens 16*c* with a vertically oriented sawtooth pattern (FIG. 10). These vertically oriented spread lens patterns have the effect of laterally directing light into varying degrees of width to provide a full range of lateral beam patterns. The vertically oriented spread lens patterns also have the effect of eliminating a direct view of the arc of the lamp.

Visor 18 has a generally inverted U configuration and includes arcuate side wall portions 18*a* with a curvature corresponding to the curvature of the front face of the reflector and an upper flat portion 18*b*. Visor 18 is suitably secured to the front face 12*c* of the reflector with portion 18*b* uppermost and occupying a general chordal relationship with respect to the reflector. It will be seen that visor portion 18*b* angles downwardly and forwardly with respect to central axis 28 from its rear edge 18*c* to the front edge 18*d* of the visor. A sector portion 18*e* of the visor above the rear edge of portion 18*b*serves to visually block off the corresponding upper sector portion of the lens 16 of the reflector 12.

Luminaire 10 further includes a specular insert 34. Insert 34 has a flat plate-like configuration and is adapted to be positioned in the upper front region of the reflector with the front edge 34*a* of the insert positioned proximate the front face 12*c* of the reflector and proximate the rear edge 18*c* of rear visor portion 18*b* with specular front edge 34*a* separated from the rear edge 18*c* of visor portion 18*b* only by lens 16. The peripheral border 34*b* of insert 34 is sized and configured so as to be contiguous with the adjacent surfaces of the reflector throughout the extent of the peripheral border so that the insert 34 blocks any egress of light into the space 36 above the insert 34. Insert 34 has a mirror-like finish on its lower or inner face 34*c* and angles upwardly and forwardly relative to central axis 28.

Luminaire 10 further includes a vertical divider 38 of plate-like configuration and black finish positioned in reflector 12 forwardly of and below lamp 14. Specifically, divider 38 includes a rear vertical edge 38*a* positioned, for example, approximately 1 inch forwardly of focal point 26; a lower arcuate edge 38*b* configured to match the arcuate configuration of the adjacent portion of the reflector 12; a front vertical edge 38*c* positioned, for example, approximately 12 inches forwardly of focal point 26; and an upper edge 38*d* extending generally parallel to a line 40 interconnecting arc 14*a* and the lower front edge of the reflector. Divider 38 is positioned centrally of lamp 14 in vertical alignment with axis 28 and extends in the vertical plane of axis 28.

The described luminaire provides an efficient asymmetric beam pattern with improved glare and spillage control. Specifically, the elongated transversely mounted HID lamp generates a beam that is relatively wide horizontally and relatively narrow vertically; the modified parabolic reflector functions to spread the beam into a more usable pattern; the modified parabolic reflector further functions to expand the center hot spot of the beam so as to eliminate or nullify the central laser-like spike of the beam; the positioning of the arc of the lamp above the nominal focal point of the reflector has the effect of angling the beam downwardly so as to further control upward spillage and further contribute to the desired asymmetric beam pattern; the partition 38 improves upper spillage light control by limiting the apparent arc length of the lamp as viewed by the reflector along the 45° axis; and the specular insert 34 in combination with the visor flat portion 18*b* further contributes to the upward spill control by cutting off the top of the beam while redirecting what might have been trapped light back into the beam in the main central beam area.

Figure 5:
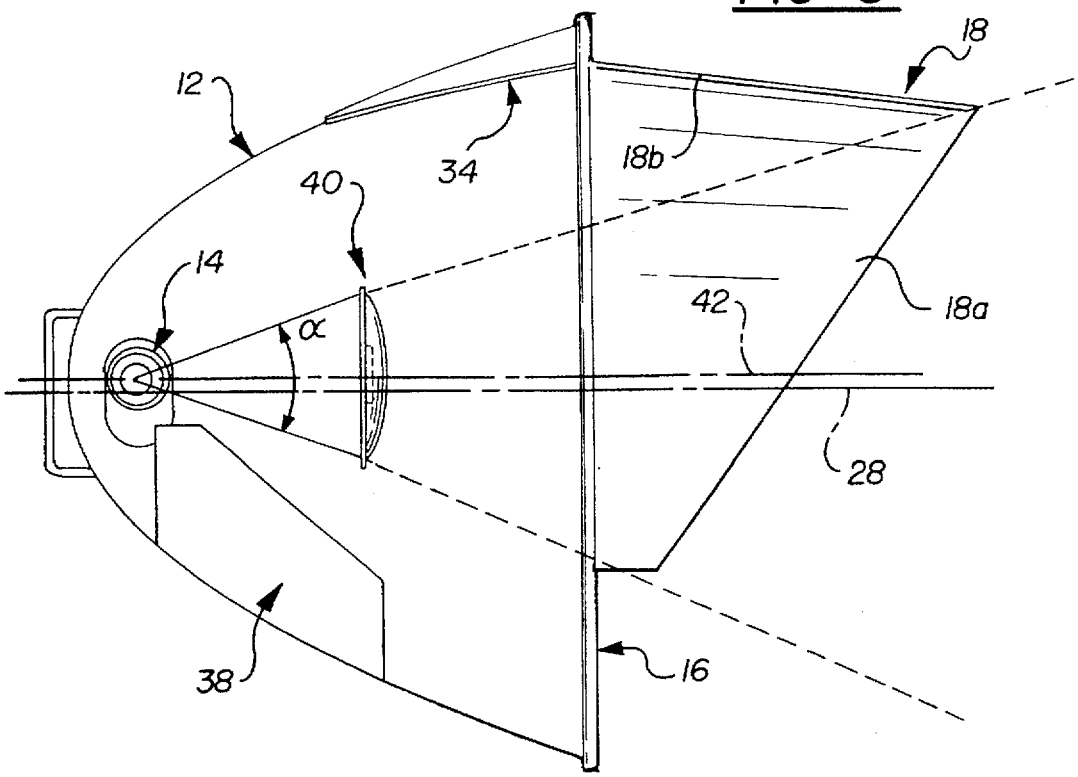
FIG. 5 is a cross-sectional view of a further embodiment of the invention luminaire.

In applications where it is especially desirable to eliminate a view of the lamp through the face of the luminaire, the embodiment seen in FIG. 5 may be employed.

The embodiment of FIG. 5 is identical to the embodiment of FIGS. 1–4 with the exception that a stepped lens 40 is added to effectively block the view of the lamp. Lens 40 has a plano-convex configuration with the plano side facing the lamp and is preferably positioned on the axis 4 of the lamp arc 14*a* by a distance approximating the lens focal length. Lens 40 has a plurality of steps 40*a*, 40*b*, etc. formed in known manner in the plano face of the lens. Lens 40 functions over a lens collection angle $\alpha$ to collect and focus the light from the lamp that would otherwise spill out of the face of the luminaire and directs an image of the lamp into the center of the beam. By displacing the lens upward or downward the image moves up or down to reinforce the beam produced by the reflector, which can add asymmetry to the resultant beam. Moving the lens slightly out of focus (toward or away from the lamp) softens or spreads the beam produced by the lens to nearly equal the beam produced by the reflector. The position of the lens therefore provides the ability to hide the view of the lamp and produce a more desirable beam pattern. The size, lens type, and focal length are variables in the choice of the lens. The lens must be larger than the arc of the lamp (4¼ inches as shown) to accomplish the ability of hiding the arc. If the lens is too large in diameter, it blocks too much reflector which reduces the luminaire efficiency. A lens having a diameter of 6 inches and a focal length of about 6 inches is desirable as it produces an arc image width of about 40°. The luminaire of FIG. 5, without the lens 40, provides a reflector beam pattern with a center about 30° below the physical luminaire axis 28. The introduction of lens 40 into this beam allows the center of this beam to be raised so that the center of the beam more closely corresponds to the axis of the luminaire. The overall beam pattern, however, does not change which results in improved asymmetry of the beam by a more rapid intensity reduction above the axis of the beam to the upper beam cutoff. Further, a more gradual decline of the beam intensity below the axis is achieved which results in a more usable and efficient beam pattern. The lens therefore eliminates the visual glare from the lamp and improves the asymmetric beam pattern.

As previously indicated, an alternate means of blocking the view of the lamp to reduce visual glare is to replace the clear window lens 16 with a fluted or sawtooth patterned glass 16*a*, 16*b*, or 16*c*. This means of reducing the glare from the lamp replaces the direct view of a bright arc by multiple small pieces of the arc spread by the lens. As the bright arc is broken into many images and spread over an appreciable area, the arc brightness is greatly reduced and blends into the beam from the reflector. As the lens/reflector combination spreads the beam, the apparent brightness of the lamp is reduced whereby to reduce glare when viewed within the beam. The glare outside the beam and the zone where the lamp is viewed through the clear lens is a function of light scattered by the clear or spread lens and reflector surfaces. This glare is not of great concern and the change from the clear to a spread lens does not appreciable alter it.

In applications where a more intense narrow central beam is desired, the embodiment of FIG. 7 may be employed. The embodiment of FIG. 7 is generally similar to the embodiment of FIGS. 1–4 with the exception that a true parabolic reflector bowl 42 is inserted in the rear portion of the modified parabolic reflector 12 and the lamp 14 is moved to coincide precisely with the focal point 43 of true parabolic reflector bowl 42. The beam produced by bowl 42 is of the "bow-tie" or "dog bone" shape typical of a parabolic reflector with a cross axis light source. The front half of the main tipped surface of revolution reflector 12 focuses light into the central area of the "bow-tie" or "dog bone" pattern which increases the central beam intensity. These combined beams create an increased intensity, narrow, vertical and wider lateral beam with a larger more uniform center. If the modified parabolic reflector 12 has a focal length of 2½ inches, the true parabolic bowl 42 may have a focal length of 2 inches.

Figure 12:
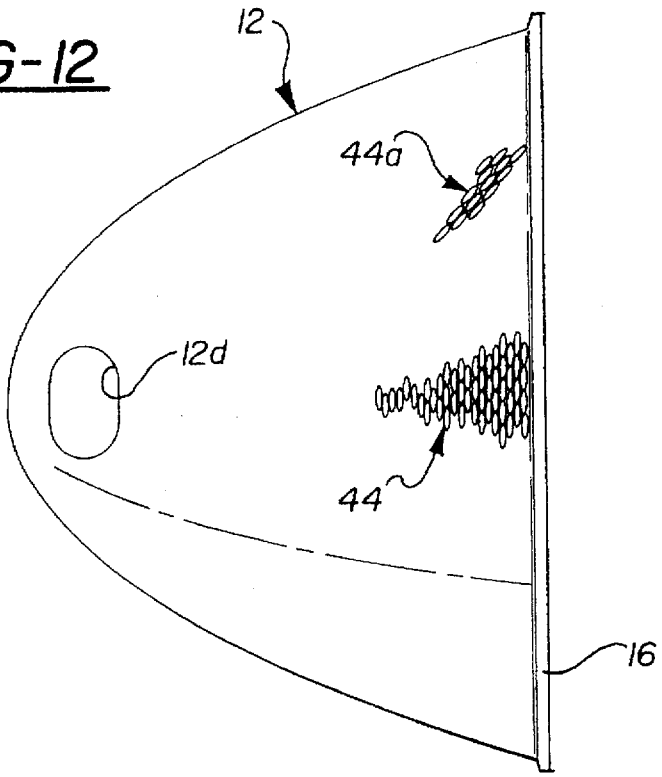
Figure 13:
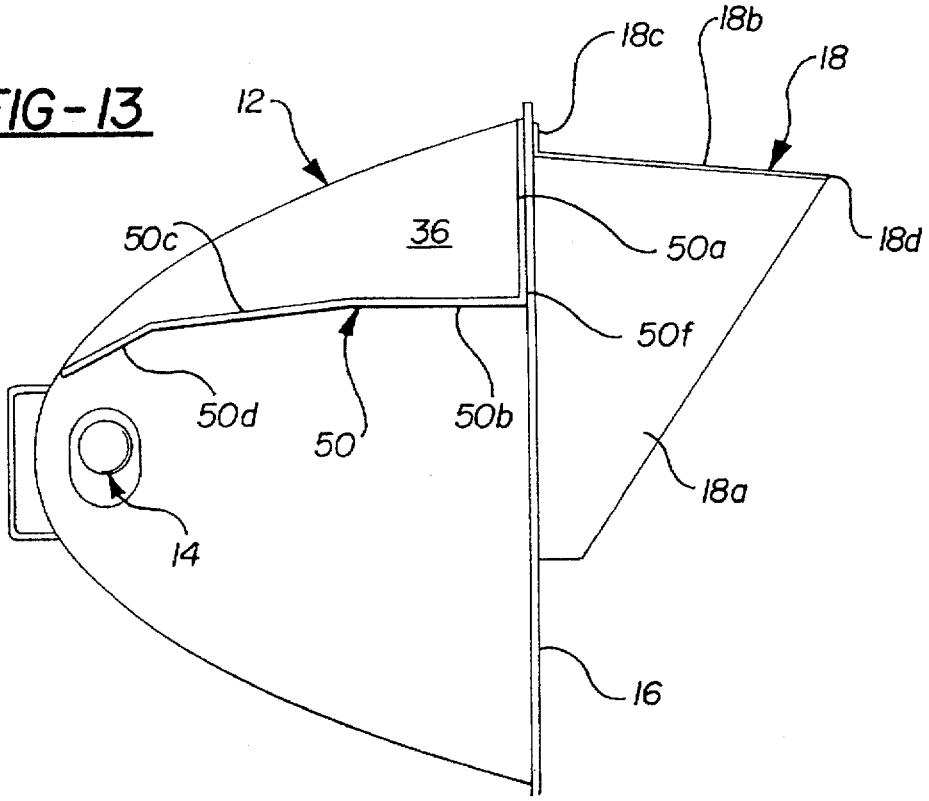
FIG. 13 is a cross-sectional view of a yet further embodiment of the invention luminaire.
Figure 14:
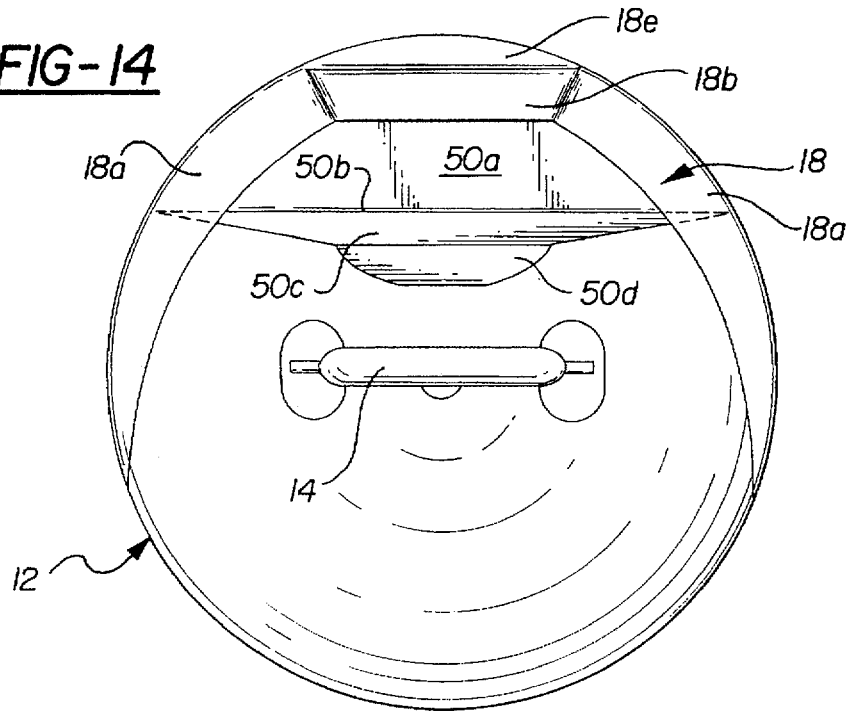
FIG. 14 is a frontal view of the luminaire of FIG. 13.
Figure 15:
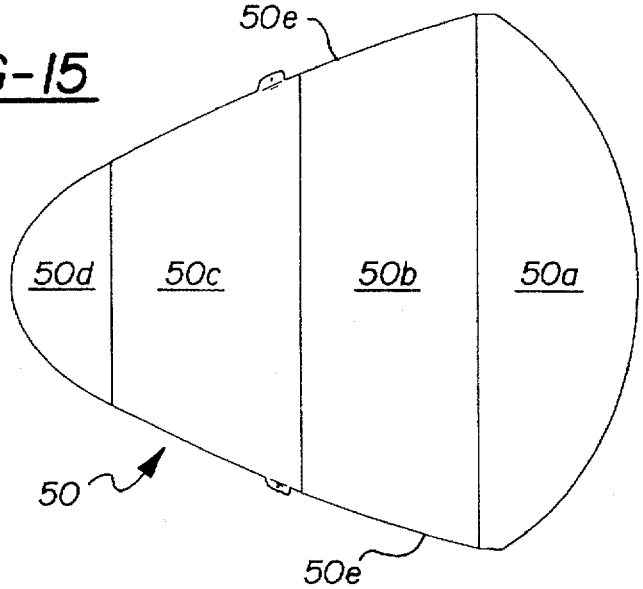
FIG. 15 is an undeveloped plan view of a specular insert employed in the luminaire of FIGS. 13 and 14.
Figure 16:
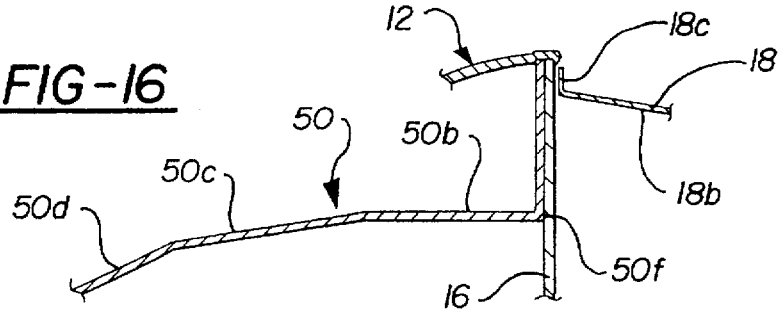
FIG. 16 is a developed edge view of the insert of FIG. 15.

In applications where it is desired to selectively spread the beam emitted by the luminaire, a peening pattern such as seen in FIGS. 11 and 12 may be employed.

The peening pattern of FIGS. 11 and 12 divides the reflective inner surface of reflector 12 into areas A, B, C, D, and E. Area E is a rear circular area centered on the central axis 28 of the reflector; area D is an annular area in concentric surrounding relation to area E; areas C and B are arcuate areas arranged successively radially outwardly of area D and centered on axis 28 but extending for only 240° about the axis; and area A is located in the lower half of the reflector on opposite sides of central partition 38, has an arcuate configuration, and occupies the 120° of reflector surface not occupied by areas B and C.

Areas A and E are not peened and areas B, C, and D are covered with vertical peens 44 (except for openings 12*d*). The peening in areas B, C, and D may be identical or be selectively varied to selectively control the shape and nature of the beam generated by the reflector. For example, the peens 44 in area B may be produced by a rod having a one inch diameter and a width of 0.25 inches; the peens 44 in area C may be produced by a rod having a one inch diameter and a width of 0.20 inches; and the peens 44 in area D may be produced by a rod having a one inch diameter and a width of 0.15 inches. The peons 44 when viewed from the front, as in FIG. 11, are oriented vertically but when viewed in section, as in FIG. 12, appear vertical at the cross axis and at a 45° angle on the 45° axis 44*a*. It will be seen that in the described peening pattern identical truncated pie-shaped reflector surfaces on either lateral side of the partition 38 are devoid of peening so as not to interfere with the cut off light control of the partition. It will be understood that, in embodiments of the invention including the specular insert 34, the upper regions of reflector surface areas C and D covered by the specular insert would not require peening.

The luminaire seen in FIGS. 13–16 is employed in installations where the luminaire is mounted near the edge of a playing field and has the effect of directing light directly downwardly beneath the luminaire and proximate the edge of the field.

In the luminaire of FIGS. 13–16, specular insert 34 is replaced with an enlarged specular insert 50. Insert 50 is seen in its flat, undeveloped condition in FIG. 15 and in its bent, developed condition in FIG. 16 in which it includes an upstanding partition portion 50*a*, a generally flat front portion 50*b* positioned at 90° with respect to partition portion 50*a*, an intermediate portion 50*c* bent downwardly with respect to portion 50*b* by an angle of, for example, 8° and a rear portion 50*d* bent downwardly with respect to portion 50*b* by an angle of, for example, 28°.

The peripheral border 50*e* of insert portions 50*b*, 50*c*, and 50*d* is sized and configured, with the insert bent and installed in reflector 12, so as to be contiguous with the adjacent surfaces of the reflector throughout the extent of the peripheral border so that the insert blocks any egress of light into the space 36' above the insert. When installed, the partition portion 50*a* is positioned immediately behind the upper portion of lens 16 and the front edge 50*f* defined by the crease line between portions 50*a* and 50*b* is positioned against the lens below the rear edge 18*c* of rear visor portion 18*b*.

The use of this enlarged specular insert, with consequent lower beam spread, is required where luminaire mounting locations are near the edge of a playing field in small, often recreational facilities.

It will be understood that the specular insert, whether the smaller insert 34 or the larger insert 50, does not modify the upward spill control or reduce the luminaire efficiency but only extends light from where the luminaire is aimed back towards the luminaire mounting location.

The invention luminaire will be seen to provide many important advantages. In general, and as set forth in the objects of the invention, the invention provides a more efficient, asymmetric beam pattern with improved upper beam cutoff.

Specifically, the use of a transversely mounted arc lamp in combination with a tipped or modified parabolic reflector provides an asymmetric beam of desired configuration and quality while minimizing upward spill and softening the central spike of the beam; the use of a vertical, black finish partition forwardly and below the lamp minimizes the light directed upwardly from the bottom front area of the reflector on either side of the lower vertical axis of the reflector; positioning of the lamp above the focal point of the reflector has the effect of tipping the central axis of the beam downwardly to minimize spillage and to contribute to the desired asymmetric beam configuration; the use of the specular insert in combination with the visor flat portion reflects light directly into a usable area of the beam and eliminates trapped light; the use of a stepped lens positioned within the reflector and spaced forwardly of the lamp by the focal length of the lens effectively eliminates a view of the bright arc of the lamp and the associated glare; the alternative use of a fluted or sawtooth vertically oriented spread lens to replace the clear window lens reduces lamp glare and increases the lateral beam spread; and the use of an insert of true parabolic configuration within the modified parabolic reflector, in combination with location of the lamp on the focal point of the parabolic insert, produces a narrow concentrated beam with the front of the main tipped surface of the primary reflector functioning to introduce light into the central area of the pattern to increase the central beam intensity.

Whereas preferred embodiments of the invention have been illustrated and described in detail it will be apparent that various changes may be made in the disclosed embodiments without departing the scope or spirit of the invention. For example, although the invention luminaire has been described with specific reference to sports lighting applications, the invention luminaire has many other lighting applications including use for high mast roadway illumination and other wide area lighting requirements. Further, although the invention luminaire has been described with respect to a double-ended HID lamp, the invention luminaire has applicability to single-ended lamps and/or high pressure sodium lamps.

We claim:

1. A luminaire including a generally parabolic reflector, having a central aiming axis and a front face, and a lamp positioned within the reflector characterized in that:

the lamp extends transversely of the aiming axis; and the reflector is formed by establishing a parabolic curve having a back end, a front end, and a focal point with the central aiming axis of the reflector passing through the back end of the curve and the focal point of the curve, tilting this curve at an angle to the aiming axis, and rotating this curve about the central aiming axis to produce the surface of revolution of the reflector.

2. A luminaire according to claim 1 wherein the lamp is positioned proximate the focal point but above the central aiming axis.

3. A luminaire according to claim 2 wherein the luminaire further includes a generally vertical partition positioned in the reflector below the lamp and generally centrally of the lamp.

4. A luminaire according to claim 3 wherein the partition extends generally in the vertical plane of the aiming axis.

5. A luminaire according to claim 1 wherein the luminaire further includes a flat specular insert positioned within the reflector above the lamp in the forward upper portion of the reflector.

6. A luminaire according to claim 5 wherein the luminaire further includes a visor positioned on the front face of the reflector and defining a flat upper portion extending forwardly from a location proximate the front face of the reflector and proximate a front edge of the specular insert.

7. A luminaire according to claim 6 wherein the specular insert is angled upwardly relative to the central axis and the visor flat portion extends downwardly from the front edge of the specular insert to the front end of the visor.

8. A luminaire according to claim 7 wherein the luminaire further includes a lens positioned on the central axis between the lamp and the front face of the reflector.

9. A luminaire according to claim 8 wherein the lens is positioned forwardly of the lamp by a distance corresponding generally to the focal length of the lens.

10. A luminaire according to claim 1 wherein the luminaire further includes a lateral spread lens covering the front face of the reflector and operative to increase the width of the beam generated by the luminaire and to reduce direct lamp glare.

11. A luminaire according to claim 10 wherein the spread lens comprises a vertically fluted lens.

12. A luminaire according to claim 1 wherein the luminaire further includes a parabolic reflector bowl positioned in the center back half of the reflector.

13. A luminaire according to claim 12 wherein the lamp is positioned at the focal point of the reflector bowl.

14. A luminaire comprising:

a reflector of generally parabolic configuration defining a central aiming axis and a front face;

an elongated lamp positioned within the reflector and extending transversely of the aiming axis; and a generally vertical partition positioned in the reflector below the lamp and extending generally parallel to the aiming axis.

15. A luminaire according to claim 14 wherein the luminaire includes a lateral spread lens covering the front face of the reflector and operative to increase the width of the beam generated by the luminaire and reduce direct lamp glare.

16. A luminaire according to claim 15 wherein the spread lens comprises a vertically fluted lens.

17. A luminaire according to claim 16 wherein the partition is positioned generally centrally of the lamp.

18. A luminaire according to claim 16 wherein the lamp is a double-ended arc lamp.

19. A luminaire according to claim 16 characterized in that the reflector is formed by establishing a parabolic curve having a back end, a front end and a focal point with the central aiming axis passing through the back end and the focal point, tilting this curve at an angle to the aiming axis, and rotating this curve about the central aiming axis to produce the surface of revolution of the reflector.

20. A luminaire according to claim 19 wherein the tilt angle is greater than four degrees and less than eight degrees.

21. A luminaire according to claim 16 wherein the luminaire further includes a flat specular insert positioned proximate the upper front end of the reflector and angled upwardly relative to the central axis to direct light downwardly and forwardly into a usable area of the reflector beam.

22. A luminaire according to claim 21 wherein the luminaire further includes a visor positioned on the front face of the reflector and including a flat upper portion extending forwardly from a location proximate the front face of the reflector and proximate a front edge of the specular insert for coaction with the specular insert.

23. A luminaire according to claim 22 wherein the visor flat portion angles downwardly relative to the central axis from the front face of the reflector to the front end of the visor.

24. A luminaire according to claim 14 wherein the luminaire further includes a lens positioned generally on the central reflector axis at a location between the lamp and the front face of the reflector.

25. A luminaire according to claim 24 wherein the lens is positioned forwardly of the lamp by a distance corresponding generally to the focal length of the lens.

26. A luminaire according to claim 25 wherein the lens comprises a stepped lens of plano-convex configuration with the convex surface facing forwardly.

27. A luminaire according to claim 26 wherein the lamp is an arc lamp and the lens has a diameter which is at least as great as the length of the arc of the lamp.

28. A luminaire according to claim 27 wherein the lamp is positioned proximate the focal point plane of the reflector.

29. A luminaire including:

a reflector defining a central aiming axis and a front face;

a lamp positioned within the reflector; and a visor positioned on the front face of the reflector and including lateral side wall portions extending downwardly along opposite sides of the reflector and an upper portion extending transversely across the upper region of the visor, extending forwardly from the front face of the reflector, and terminating in a generally flat forward edge located above the aiming axis, a flat specular insert positioned in the upper forward region of the reflector and having a front edge positioned proximate the front face of the reflector and proximate a rear edge of the flat visor portion.

30. A luminaire according to claim 29 wherein the specular insert is angled upwardly relative to the central axis of the reflector and the flat visor portion is angled downwardly relative to the central axis.

31. A luminaire according to claim 29 wherein the lamp further includes a lateral spread lens covering the front face of the reflector and operative to increase the width of the beam generated by the luminaire and reduce direct lamp glare.

32. A luminaire according to claim 1 wherein the surface of the reflector includes a pattern of vertical peens operative to laterally spread the beam generated by the luminaire.

33. A luminaire according to claim 14 wherein the reflective surface of the reflector includes a pattern of vertical peens operative to laterally spread the beam generated by the luminaire.

34. A luminaire according to claim 33 wherein the reflective surface on either lateral side of the partition is devoid of peening.

35. A luminaire comprising:

a generally parabolic reflector having a central aiming axis and a front face;

an elongated lamp positioned proximate to and extending transversely of the aiming axis, and a lens positioned proximate the aiming axis at a location between the lamp and the front face of the reflector.

36. A luminaire comprising:

a generally parabolic reflector having a central aiming axis and a front face;

a lamp positioned proximate the aiming axis;

a lens positioned proximate the aiming axis at a location between the lamp and the front face of the reflector; and a flat specular insert positioned in the upper forward region of the reflector and angled upwardly relative to the central axis.

37. A luminaire according to claim 35 wherein the lamp comprises a double-ended arc lamp.

38. A luminaire according to claim 36 wherein the luminaire further includes a visor positioned on the front face of the reflector and including a flat upper portion extending from a location proximate the front face of the visor and proximate a front edge of the specular insert to the front end of the visor.

39. A luminaire according to claim 38 wherein the flat visor portion extends downwardly and forwardly relative to the central axis.

* * * * *